United States Patent [19]

Forster

[11] 3,992,885

[45] Nov. 23, 1976

[54] DRIVE ARRANGEMENT FOR THE AUXILIARY AGGREGATES OF A MOTOR VEHICLE

[75] Inventor: Hans-Joachim M. Forster, Stuttgart, Germany

[73] Assignee: Daimler-Benz Aktiengesellschaft, Germany

[22] Filed: Apr. 9, 1975

[21] Appl. No.: 566,327

[30] Foreign Application Priority Data

Apr. 10, 1974 Germany ..... 2417434

[52] U.S. Cl. ..... 60/698; 60/706; 180/1 R; 290/1 R; 322/2 R

[51] Int. Cl.[2] ..... F01B 21/00; F02D 29/06

[58] Field of Search ..... 310/4 R; 60/698, 706, 60/721; 180/1; 322/2; 290/1

[56] References Cited

UNITED STATES PATENTS

| | | | |
|---|---|---|---|
| 1,118,269 | 11/1914 | Creveling | 60/320 |
| 3,104,528 | 9/1963 | Horig | 60/721 |
| 3,558,901 | 1/1971 | Jacobus | 60/721 |
| 3,719,881 | 3/1973 | Shibata et al. | 60/721 |

*Primary Examiner*—Allen M. Ostrager
*Attorney, Agent, or Firm*—Craig & Antonelli

[57] ABSTRACT

A drive arrangement for the auxiliary aggregates of a motor vehicle equipped with an internal combustion engine which includes an electrical power supply system with a generator and a battery; only those auxiliary aggregates which have a power requirement dependent on the rotational speeds are thereby driven from the internal combustion engine as heretofore whereas all auxiliary aggregates which have a power requirement independent of the rotational speed are driven in common from an electrical motor operating at substantially constant rotational speed and fed from the electrical power supply system; a thermionic converter operable by means of the fuel of the motor vehicle is thereby provided as generator.

10 Claims, 1 Drawing Figure

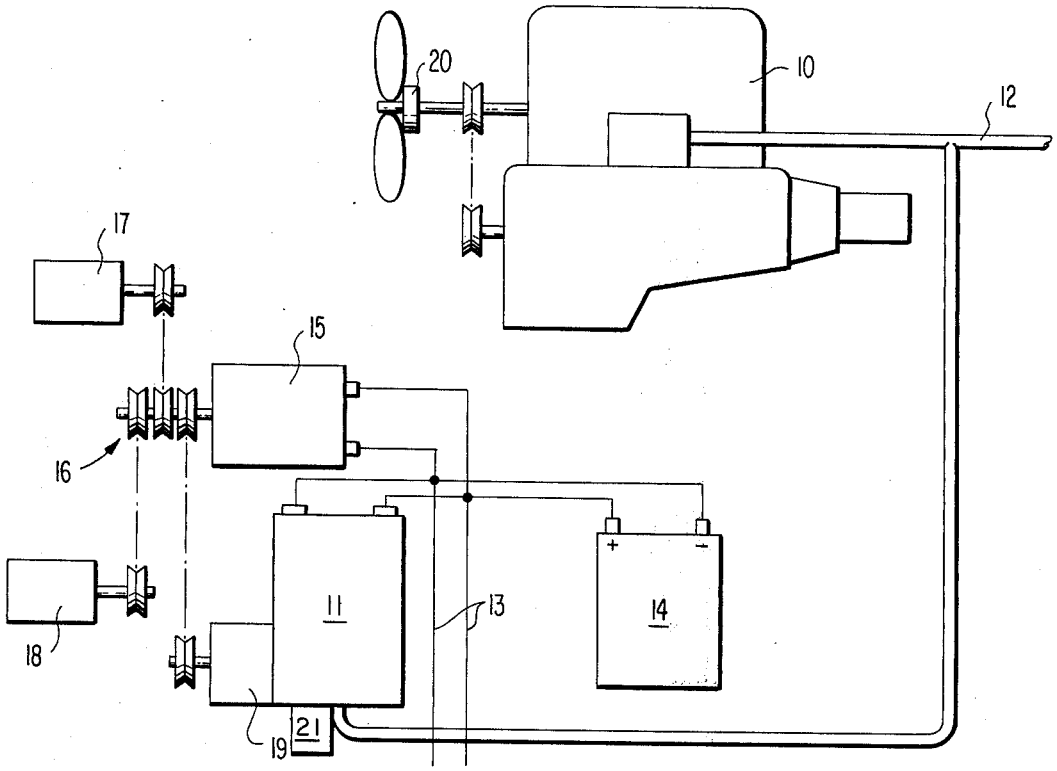
20
10
12
17
15
16
11
13
14
18
19
21

DRIVE ARRANGEMENT FOR THE AUXILIARY AGGREGATES OF A MOTOR VEHICLE

The present invention relates to a drive arrangement for the auxiliary aggregates of a motor vehicle equipped with an internal combustion engine which includes an electrical power supply system with a generator and an accumulator battery.

The drive of the auxiliary aggregates for the internal combustion engine and/or for the motor vehicle takes place in a known manner by the driving engine itself. A generator, a so-called alternator, is thereby provided for feeding the power supply system, which is also driven from the internal combustion engine itself. With this known drive, considerable disadvantages result from the fact that the internal combustion engine has a very large rotational speed range whereas at least a part of the auxiliary aggregates have a power requirement independent of the rotational speeds. Consequently, attempts have already been made to interconnect between the internal combustion engine and the corresponding auxiliary aggregates rotational speed converters which, however, is always very complicated.

Furthermore, the electrical individual drive, for example, of a fan is known in the art. However, such an arrangement entails a large expenditure, for the chemical energy of the fuel has to be converted at first always in the engine into mechanical energy, and this mechanical energy then has to be converted in the alternator into electrical energy which finally has to be transformed in the electric motor back into mechanical energy. Added thereto is the fact that the inability of the present-day alternators, to produce sufficient electrical energy during idling, renders the danger of a discharge of the starter battery the greater, the more electrical loads are connected to the system.

The present invention is therefore concerned with the task to avoid the described disadvantages and to provide a drive arrangement which, combined with a high efficiency, offers a simple construction, i.e., an electrical drive of the auxiliary aggregates is to be realized. The underlying problems are solved according to the present invention with the arrangements of the aforementioned type in that only the auxiliary aggregates with a power requirement dependent on the rotational speed are adapted to be driven by the internal combustion engine itself as heretofore whereas all auxiliary aggregates with a power requirement independent of the rotational speed are adapted to be driven in common from an electric motor fed from the power supply system and having a constant rotational speed and in that a thermionic converter operable with the fuel of the motor vehicle is provided as generator.

Thus, a pump for the servo-steering system, a pump for any existing high pressure hydraulic system as well as any existing cooling compressor and under certain circumstances also the fan of the internal combustion engine can thus be driven, for example, from the common electric motor. This drive need not necessarily take place with the same rotational speed. It is also feasible within the scope of the present invention, for example, to interconnect between the electric motor and the individual auxiliary aggregates to be driven thereby, different rotational speed transmissions, for example, by V-belts. For example, auxiliary aggregates such as the engine oil pump, the water pump, etc. then remain for the drive from the internal combustion engine itself.

The present invention prefers for the thermionic converter a construction, according to which the latter is so designed that it has the best efficiency at full rated power output. It will then be operated only in the full load range whereby the partial load range can be taken into consideration by intermittent operation. A blower for the supply of the combustion air is naturally coordinated to the thermionic converter which may also be connected to the common electric motor.

Accordingly, it is an object of the present invention to provide a drive arrangement for the auxiliary aggregates of a motor vehicle which avoids by simple means the aforementioned shortcomings and drawbacks encountered in the prior art.

Another object of the present invention resides in a drive arrangement for the auxiliary aggregates of a motor vehicle which eliminates the drawback of the large rotational speed range of the internal combustion engine as regards those auxiliary aggregates which do not have a power requirement dependent on rotational speed.

A still further object of the present invention resides in a drive arrangement for the auxiliary aggregates of a motor vehicle which exhibits a high efficiency without the need of complicated devices interconnected in the drive arrangement.

Still another object of the present invention resides in a drive arrangement for the auxiliary aggregates of a motor vehicle which eliminates the danger of a discharge of the battery as a result of the connection of several loads during idling of the engine.

Another object of the present invention resides in a drive arrangement for the auxiliary aggregates of a motor vehicle which combines a high efficiency with simple construction.

These and further objects, features and advantages of the present invention will become more apparent from the following description when taken in connection which the accompanying drawing which shows, for purposes of illustration only, one embodiment in accordance with the present invention, and wherein:

The single FIGURE is a schematic view of a drive arrangement in accordance with the present invention in which the spatial arrangement has not been taken into consideration for sake of simplicity.

Referring now to the single FIGURE of the drawing, the internal combustion engine 10 as well as a thermionic converter 11 are fed with fuel from a line 12. The thermionic converter 11 which is of conventional construction and whose operation therefore need not be explained in detail herein, feeds the power supply network 13 of the motor vehicle whereby a battery 14 is provided as storage device or accumulator. The different loads (not illustrated) are then connected to the power supply network 13.

An electric motor 15 is also connected with the power supply network 13 which serves as common drive for all of those auxiliary aggregates which have a power requirement independent of the rotational speed. The electric motor 15 rotates at constant or at least nearly constant rotational speed and drives possibly by way of intermediate drives, for example, by way of V-belt disks 16, the individual aggregates, for example, a pump 17 for the servo-steering system or a cooling compressor 18 for the air conditioning installation. It further drives a small blower 19 which is coordinated to the thermionic converter 11 and which serves for the supply of the combustion air. The transmission ratios between the electric motor 15 and the individual driven auxiliary aggregates need not necessarily be identical among themselves. They may take into consideration the respective favorable operating conditions.

Only still those auxiliary aggregates are now driven by the internal combustion engine 10 itself which with an increasing rotational speed must also produce an increasing power output. Among those may belong under certain circumstances the fan 20. Additionally, the engine oil pump (not shown) and the water pump (not shown) for the cooling system may belong thereto. The drive of these aggregates takes place as heretofore in a mechanical manner, for example, by V-belt drives. For the sake of completeness, it should also be mentioned that the fan 20 may also be connected, for example, to the common electric motor 15.

The thermionic converter 11 is preferably so designed that it produces maximum efficiency at rated, full output. It will then be operated only at this rated output whereby the partial load ranges are taken into consideration by operating the thermionic converter 11 intermittently by the use of conventional control means 21, known as such in the art and therefore not described in detail herein, and which may include an automatic timing circuit means for the intermittent operation of the converter 11 in dependence on at least the power requirements in the power supply network and on the charge condition of the battery.

While I have shown only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A drive arrangement for auxiliary aggregates of a motor vehicle equipped with an internal combustion engine, which comprises an electrical power supply means including a generator means and a battery means, characterized in that only the auxiliary aggregates having a power requirement dependent on rotational speed are operable to be driven by the internal combustion engine whereas the auxiliary aggregates having a power requirement substantially independent of rotational speed are operable to be driven from an electric motor rotating at substantially constant rotational speed and fed from the power supply means, and in that a thermionic converter means operable with the fuel of the motor vehicle is provided as generator means.

2. A drive arrangement according to claim 1, characterized in that all auxiliary aggregates having a power requirement independent of the rotational speed are driven in common from said single electric motor.

3. A drive arrangement according to claim 1, characterized in that the thermionic converter means is designed for optimum efficiency at full load and is operated only in the full load range.

4. A drive arrangement according to claim 3, characterized in that the thermionic converter means includes control means for an intermittent operation thereof in case of power requirements less than full load.

5. A drive arrangement according to claim 4, characterized in that the control means includes an automatic timing circuit means for the intermittent operation of the thermionic converter means in dependence on at least the power requirement in the power supply means and on the charge condition of the battery.

6. A drive arrangement according to claim 5, characterized in that a blower means for supplying combustion air is coordinated to the thermionic converter means, and in that this blower means is operable to be driven by said common electric motor.

7. A drive arrangement according to claim 1, characterized in that the thermionic converter means includes control means for an intermittent operation thereof in case of power requirements less than full load.

8. A drive arrangement according to claim 7, characterized in that the control means includes an automatic timing circuit means for the intermittent operation of the thermionic converter means in dependence on at least the power requirement in the power supply means and on the charge condition of the battery.

9. A drive arrangement according to claim 1, characterized in that a blower means for supplying combustion air is coordinated to the thermionic converter means, and in that this blower means is operable to be driven by said common electric motor.

10. A drive arrangement according to claim 9, characterized in that the thermionic converter means is designed for optimum efficiency at full load and is operated only in the full load range.

* * * * *